US007476049B2

(12) United States Patent
Jensen

(10) Patent No.: US 7,476,049 B2
(45) Date of Patent: Jan. 13, 2009

(54) BRUSH-LIKE APPLICATION TOOL

(76) Inventor: Steven D. Jensen, 1190 W. Chavez Dr., South Jordan, UT (US) 84095

( * ) Notice: Subject to any disclaimer, the term of this patent is extended or adjusted under 35 U.S.C. 154(b) by 0 days.

(21) Appl. No.: 11/567,367

(22) Filed: Dec. 6, 2006

(65) Prior Publication Data

US 2008/0138146 A1 Jun. 12, 2008

(51) Int. Cl.
*A47L 13/22* (2006.01)

(52) U.S. Cl. ..... 401/288; 401/287; 401/289

(58) Field of Classification Search ..... 401/287–289, 401/286; 132/113–115
See application file for complete search history.

(56) References Cited

U.S. PATENT DOCUMENTS 931,881 A * 8/1909 Marr ..... 34/99
953,452 A * 3/1910 Woodmansee ..... 401/40
2,959,801 A * 11/1960 Pelham ..... 401/281
3,378,331 A * 4/1968 Beasley ..... 401/286
3,477,447 A * 11/1969 Eldredge ..... 132/212
4,066,367 A * 1/1978 Sherosky ..... 401/286
6,158,442 A * 12/2000 Piatetsky ..... 132/115

* cited by examiner

*Primary Examiner*—David J Walczak
(74) *Attorney, Agent, or Firm*—Geoffrey E. Dobbin

(57) ABSTRACT

A tool for the containment and dispensing of materials on a work site comprises a containment body with an orifice and at least one tubule for dispensing contained material on the site. In the preferred embodiment, the tool terminates with a plurality of tubules forming a brush for the distribution of the dispensed material. Fibrous filaments may be intermingled with the tubules for increased brushing effectiveness.

11 Claims, 7 Drawing Sheets

BRUSH-LIKE APPLICATION TOOL

FIELD OF THE INVENTION

The present invention relates to the field of brushes and more particularly relates to a tool for dispensing material on a work site using a brush.

BACKGROUND OF THE INVENTION

Brushes with a reservoir or container of a material to be dispensed are known in the prior art. Typically, such brushes channel the contained material into an orifice at the base of the spreading means, usually bristles or a foam pad. As such, the material must work through the spreading means to reach the work area. Other such brushes force material onto the spreading means, which must then be employed to administer the material onto the worksite. Some brushes have bristles or other fibrous means protruding from a syringe filled with the material. These present a disadvantage as they may only handle low viscosity fluids. If a fluid presents too high a viscosity or is any viscosity suspension, the brush clogs. Therefore, most practitioners use an applicator syringe and a separate brush.

The present invention is a tool for applying material directly to a worksite from a contained reservoir. As such, material may be applied exactly where a user desires and then spread or specifically positioned as the user needs.

The present invention represents a departure from the prior art in that the tool of the present invention allows for direct application of a material to a work site from a reservoir through at least one tubule forming the brush end. This is particularly advantageous for work sites which are hard to access with a conventional brush. As such, the user needs only one tool, where in the prior art two would be necessary, particularly with higher viscosity fluids and suspensions.

SUMMARY OF THE INVENTION

In view of the foregoing disadvantages inherent in the known types of application tools, this invention provides an application tool with a material reservoir and a dispensation means directly at the target work site. As such, the present invention's general purpose is to provide a new and improved tool that is easy to use in dispensing material at a work site while efficient and precise in dispensing material on the work site itself.

To accomplish these objectives, the preferred embodiment of the tool comprises a reservoir or containment volume and a cannular channeling passage (a "cannula"). At the distal end of the cannula are at least one tubule, and ideally a plurality of the same, forming a brush-like terminal end. In practice, positive pressure is applied to the reservoir, forcing material down the cannula and out the tubules, directly where a user wants the material. The tubules may then be used as a brush to spread the material as desired. In an alternate embodiment, bristles are also utilized to increase the brush-like effect of the terminal end. While not mentioned as being preferred, a single tubule does have interesting utility in its own right, as a single tubule may be easily directed into twisted passageways and other hard to reach areas with greater efficiency than a plurality. The tubule may still have a brush-like effect if it has proper flexibility. Since tubules are used, the material does not have to work its way through the brush end, and incidence of clogging is reduced to the point of practical avoidance, even with higher viscosity fluids and suspensions.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the application tool is herein described. It should be noted that the articles "a", "an" and "the", as used in this specification, include plural referents unless the content clearly dictates otherwise.

Figure 1:
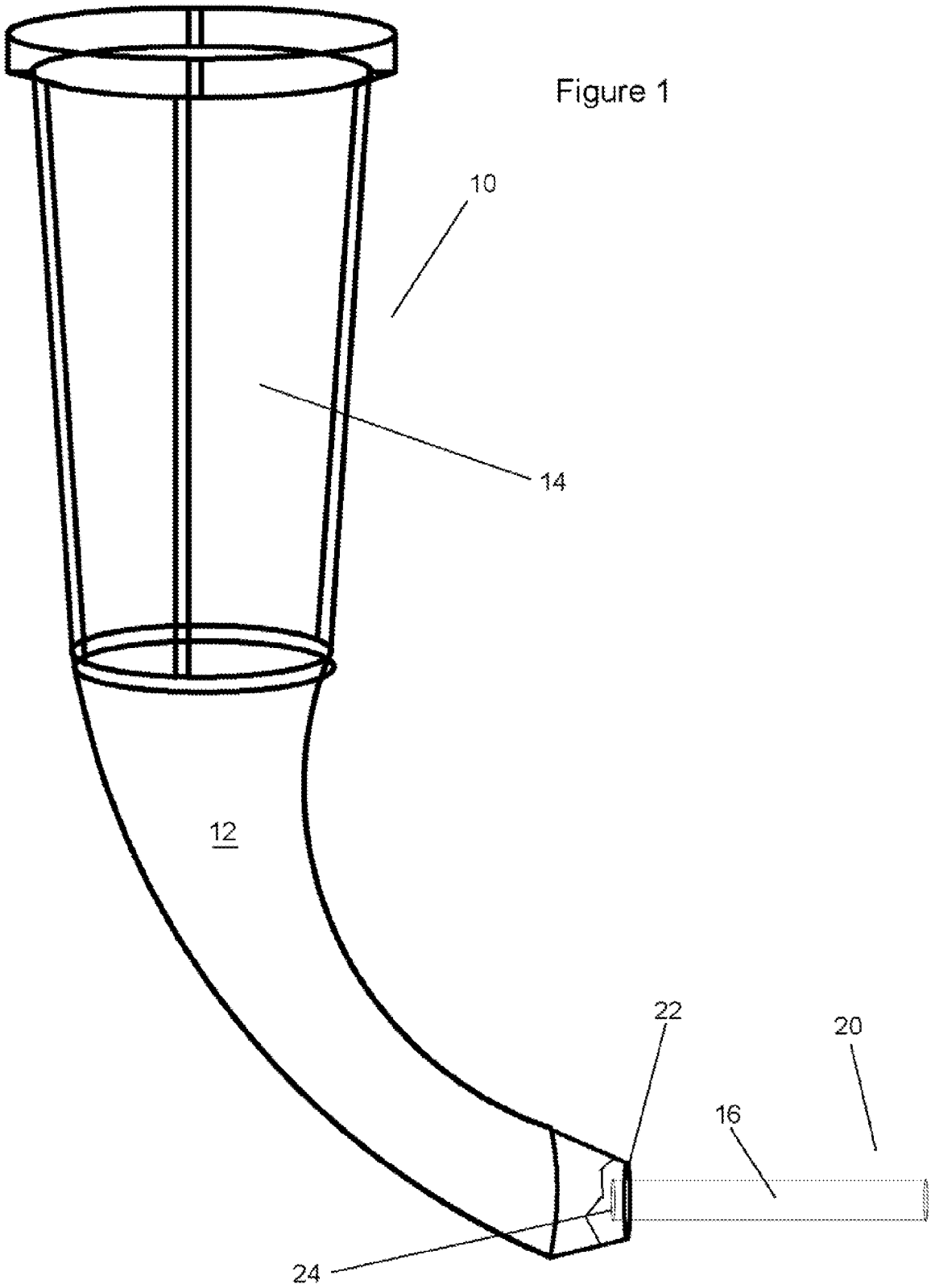
FIG. 1 is a perspective view in partial section, of a first embodiment of the invention.
Figure 5:
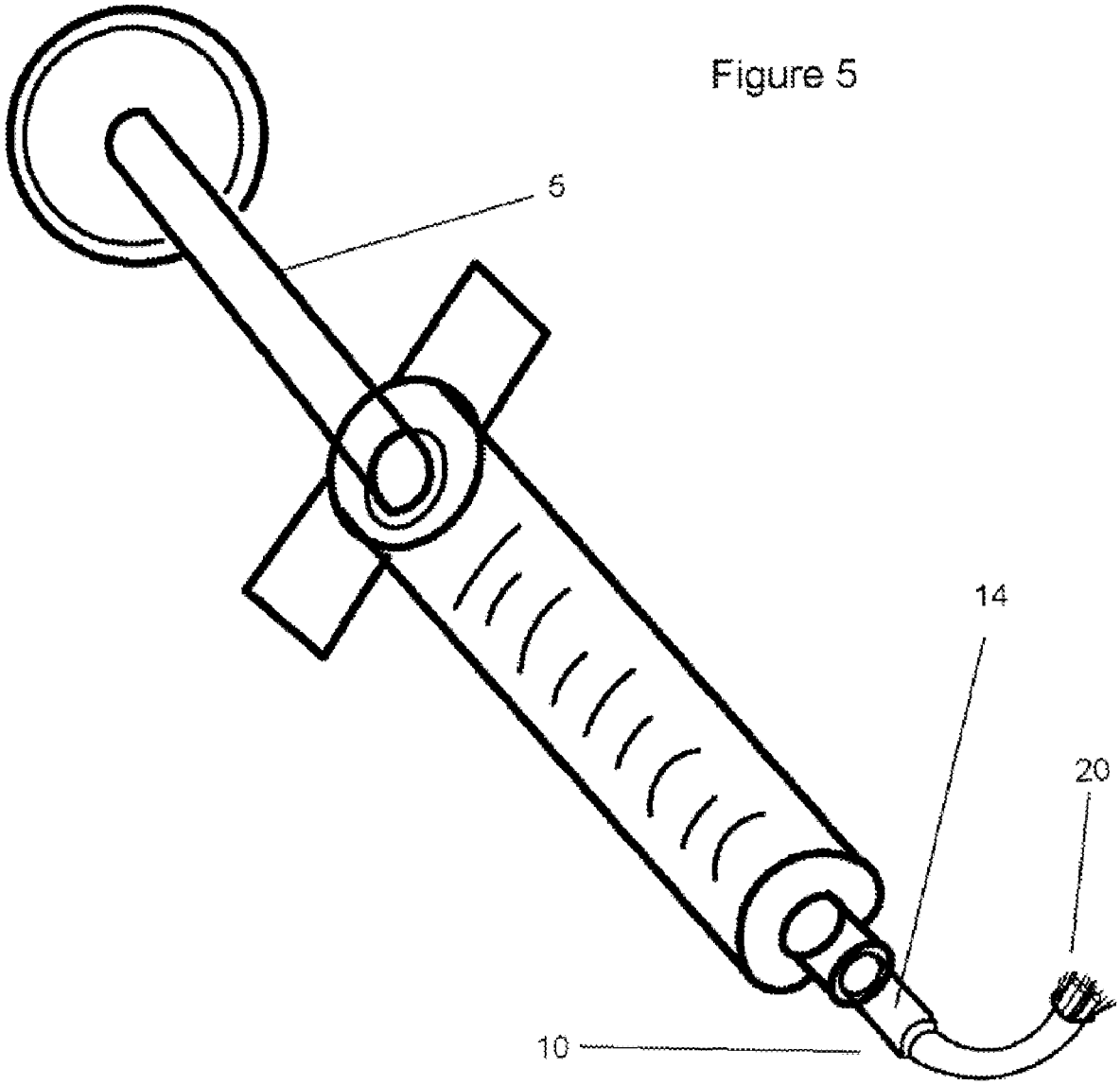
FIG. 5 is a perspective view of the invention with a syringe-styled reservoir.
Figure 6:
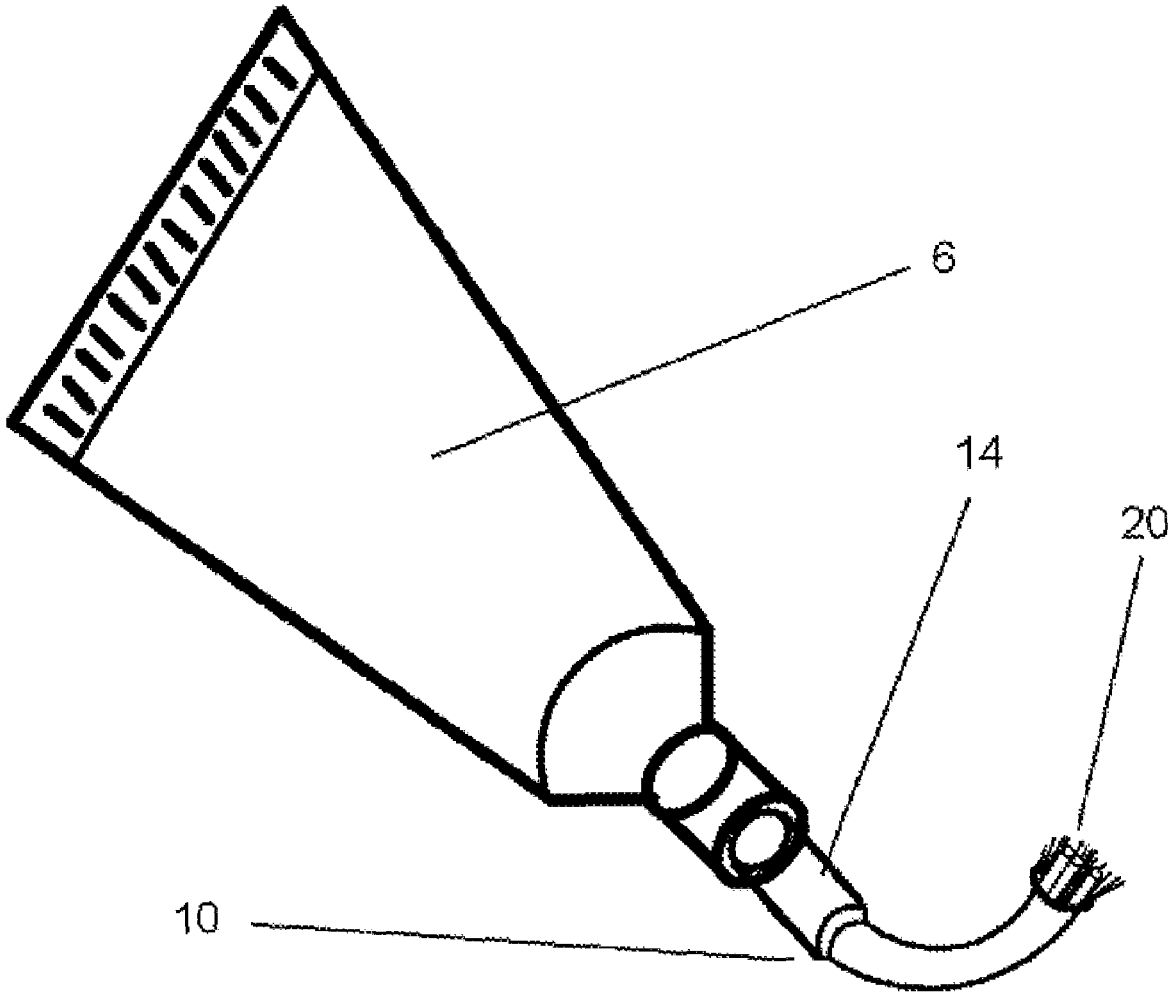
FIG. 6 is a perspective view of the invention with a tube reservoir.
Figure 7:
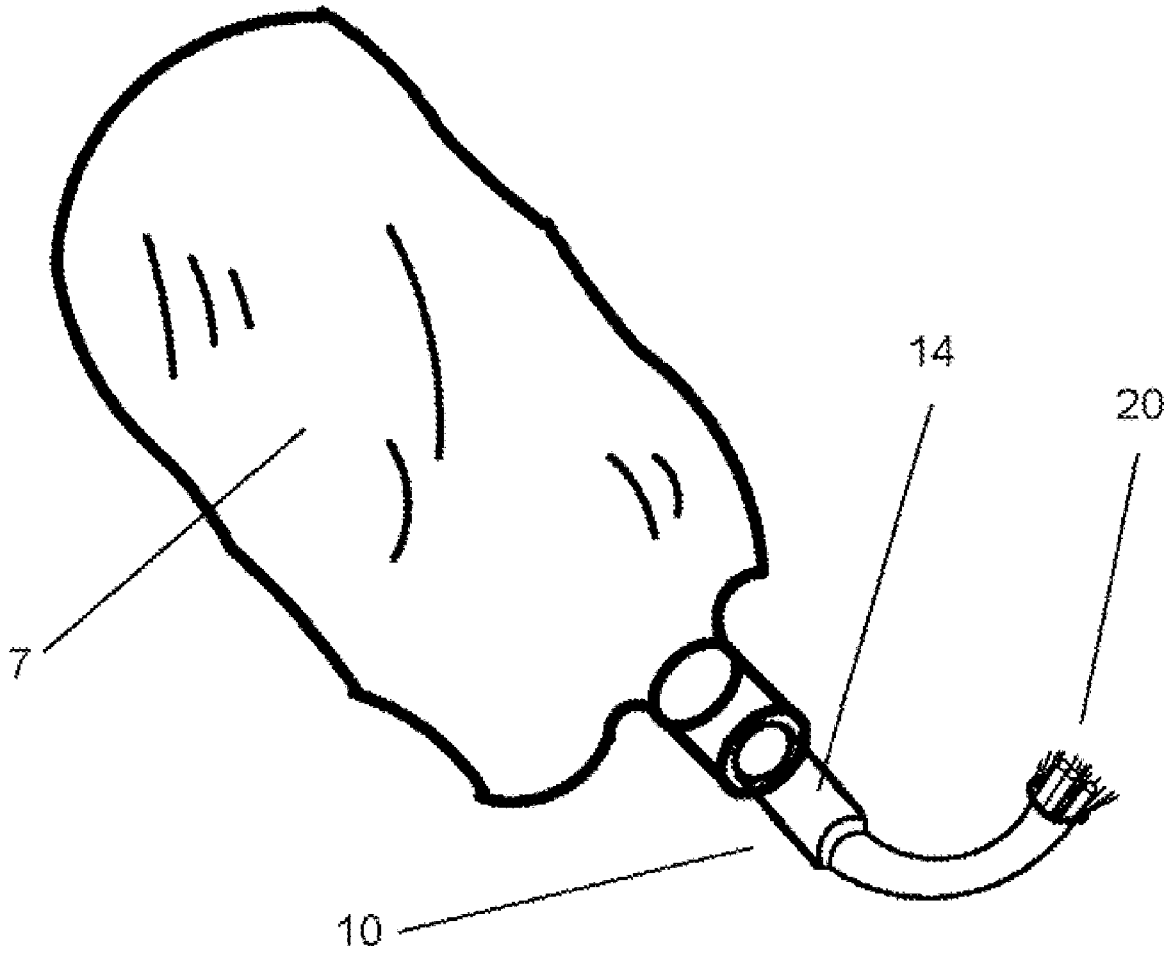
FIG. 7 is a perspective view of the invention with a bag reservoir.

With reference to FIG. 1, the tool comprises a tip attachment 10 which is attachable to a reservoir that holds the material prior to dispensation. The reservoir may take any shape known or later discovered in the art. As examples, FIGS. 5-7 depict a syringe reservoir 5, a tube reservoir 6, and a bag reservoir 7, respectively. Attachment means 14 serves as a conduit for the material from the reservoir and may be of any means known or later discovered. Presently the preferred means would be either a threaded interface, a clip-on interface or means by which the tip attachment is made integral with the reservoir (i.e. the tip is one part of a tool assembly with the reservoir). In operation, positive pressure is applied to the reservoir to force material through the attachment means 14.

This positive pressure may be applied by any traditional or later discovered means, including the use of pressurized gasses, a plunger/syringe apparatus 5, shown in FIG. 5, or merely squeezing the reservoir 6, 7. This listing is not intended to be exhaustive and any means of providing positive pressure to the reservoir is to be considered within the scope of the invention. The selection of a pressurizing means will be dependent on the scale of the invention in its use, from a micro sized, unit-dose application to a larger industrial application. As such, the illustrated means of providing positive pressure are merely examples and not an exhaustive list. Other means are considered well known and numerous in the art and the application of such means so obvious that the illustration of such abundant means is superfluous.

Figure 2:
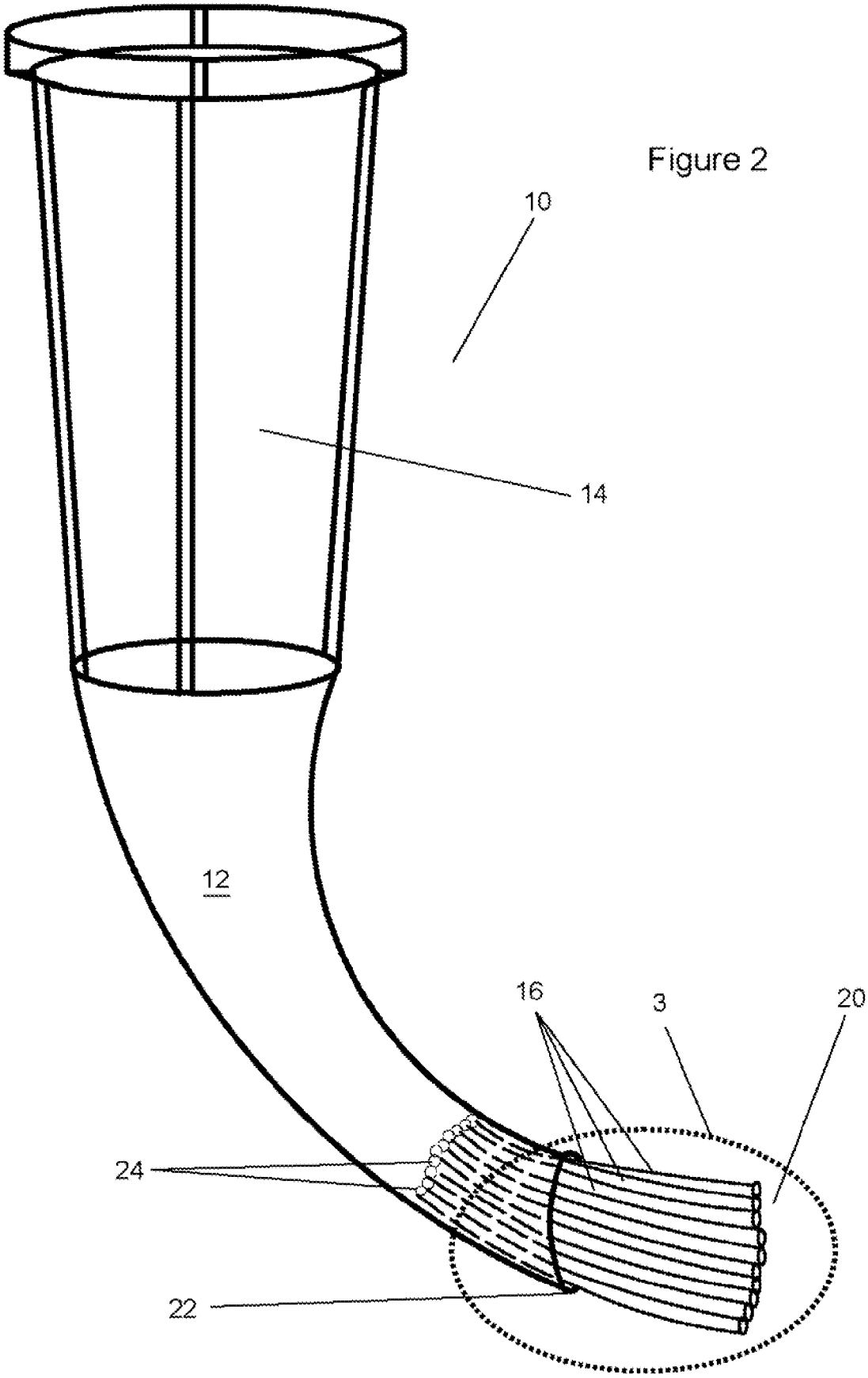
FIG. 2 is a perspective view, partially transparent, of a second embodiment of the invention.
Figure 3:
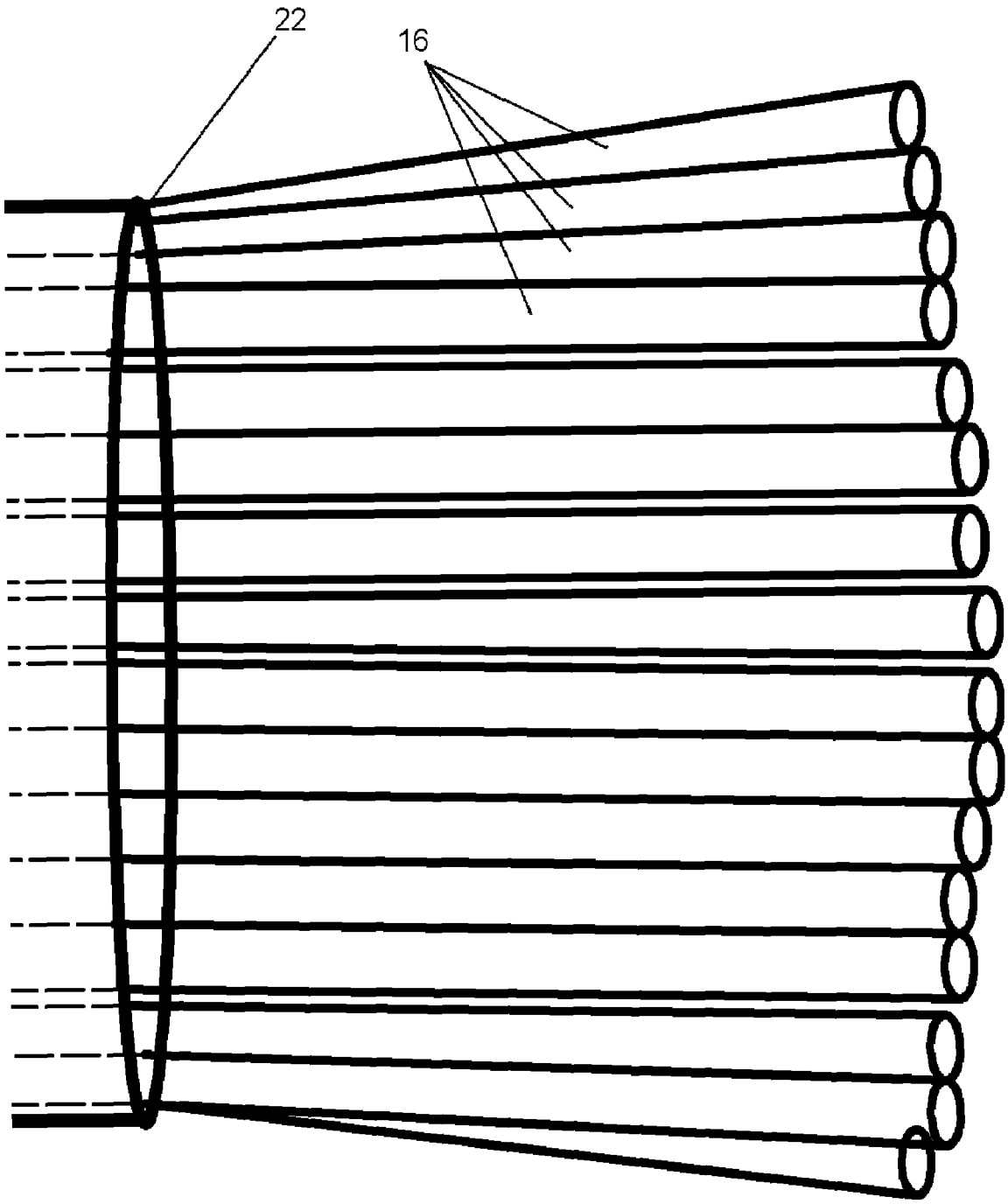
FIG. 3 is a close-up view, taken in circle 3, of the embodiment of FIG. 2.
Figure 4:
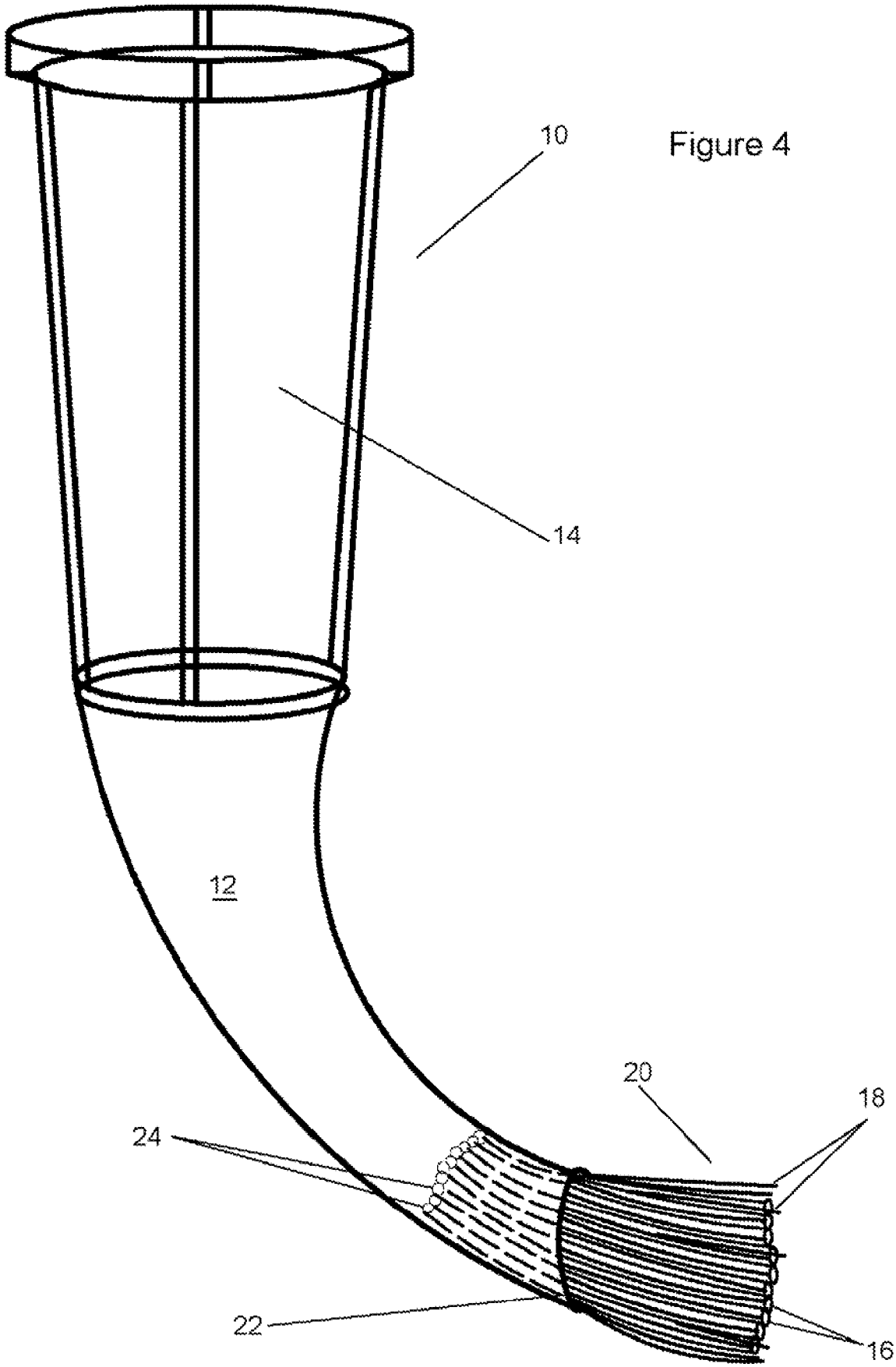
FIG. 4 is a perspective view, partially transparent, of a third embodiment of the invention.

In the preferred embodiment, a flexible cannula 12 is defined outside the attachment means 14 and, at a terminal orifice 22, at least one filament forms the brush end 20. The flexibility of the cannula aids in maneuvering the brush end 20 where a user desired material to be deposited. However, the use of cannula 12 is not an absolute necessity to the practice of the invention and the brush end 20 may extend from attachment means 14 or even from the reservoir itself for additional embodiments. In one embodiment, as seen in FIG. 1, the filament at brush end 20 is a single tubule 16 and the cannula 12 tapers for a smaller terminal orifice 22. Interior end of tubule 24 resides within the cannula 12 so that tubule 16 serves as a material conduit. For a second embodiment, shown in FIGS. 2 and 3, the filaments are a plurality of tubules 16 are used to form the brush end 20. Interior ends of the tubules 24 reside inside the cannula 12 and serve as conduits for expressing material onto the work site from the tool. In FIG. 4, a combination of tubules 16 and bristles 18 are utilized. Tubules 16 may be permanently affixed to the terminal orifice 22 of the cannula 12 by any known means, including solvent or sonic welding, use of adhesives, or simply the use of friction, whereby the elastomeric qualities of the cannula 12 are utilized to hold bristles 18 and tubules 16, in sufficient quantity and collective cross-sectional area to expand the terminal orifice 22, in place. The materials used in this invention are ideally determined by the scale a user desires. With smaller scale uses, plastics are ideal as they can be manufactured inexpensively and provide the proper balance between flexibility and rigidity. In larger scale, and possibly reusable, applications, metals and composites would ideally be used.

Tubule length in comparison to other filaments is flexible. The longer the tubule 16 in relation to bristles 18, generally the better efficiency and utility of the invention. However, it is possible to have tubules 16 extending no further than the orifice 22 itself and the invention will still function. Likewise, it is conceivable and within the scope of this invention to have the tubules 16 extending no further than the attachment means 14 (foregoing the cannula 12) or the reservoir itself, in which case the attachment means 14 serves as a form of collar for the brush end 20 extending directly from the reservoir.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A dispensing tool for a material, the tool comprising:

a. an attachment means capable of attaching to a reservoir structure;

b. a cannula extending from said attachment means, terminating at an orifice and defining a hollow interior;

c. a plurality of filaments originating within the interior of the cannula and extending at least as far away as an edge of the orifice, said plurality of filaments forming a set of filaments; and d. at least one filament of the set of filaments being a hollow tubule, said at least one hollow tubule defining a set of tubules that is lesser in number than the set of filaments and the at least one tubule terminates at the edge of the orifice;

wherein, positive pressure forces material into and through the cannula and into and through the at least one filament that is a hollow tubule.

2. The tool of claim 1, further comprising a reservoir structure to which the attachment means is already attached, wherein when positive pressure is imparted on the reservoir structure, material is forced out of the tool.

3. The tool of claim 2, further comprising a means of providing positive pressure operably connected to the reservoir structure.

4. A dispensing tool for a material, the tool comprising:

a. a syringe with a reservoir structure;

b. an attachment means capable of attaching to the reservoir structure;

c. a cannula depending from the syringe by extending from said attachment means, terminating at an orifice and defining a hollow interior;

d. at least one filament originating within the interior of the cannula and extending at least as far away as an edge of the orifice, said at least one filament forming a set of filaments; and e. at least one filament of the set of filaments being a hollow tubule;

wherein, positive pressure forces material into and through the cannula and into and through the at least one filament that is a hollow tubule.

5. The tool of claim 4, further comprising a reservoir structure to which the attachment means is already attached, wherein when positive pressure is imparted on the reservoir structure, material is forced out of the tool.

6. The tool of claim 5, the set of filaments containing a plurality of filaments.

7. The tool of claim 6, the at least one filament being a hollow tubule defining a set of tubules being lesser in number than the number of filaments in the set of filaments.

8. The tool of claim 7, the tubules in the set of tubules having at least one tubule terminating at an edge of the orifice.

9. The tool of claim 4, the set of filaments containing a plurality of filaments.

10. The tool of claim 9, the at least one filament being a hollow tubule defining a set of tubules being lesser in number than the number of filaments in the set of filaments.

11. The tool of claim 10, the tubules in the set of tubules having at least one tubule terminating at an edge of the orifice.

* * * * *